United States Patent [19]

Shen

[11] 4,187,682

[45] Feb. 12, 1980

[54] CONSTANT PRESSURE HYDRAULIC ACCUMULATOR

[75] Inventor: Jan-son Shen, Bellevue, Wash.

[73] Assignee: The Boeing Company, Seattle, Wash.

[21] Appl. No.: 66

[22] Filed: Jan. 2, 1979

[51] Int. Cl.[2] ..... F15B 1/02; F15B 1/04

[52] U.S. Cl. ..... 60/413; 60/418; 138/31

[58] Field of Search ..... 60/413, 418; 138/31

[56] References Cited

U.S. PATENT DOCUMENTS

| | | | |
|---|---|---|---|
| 2,397,270 | 3/1946 | Kelly | 138/31 |
| 2,417,256 | 3/1947 | Kremiller | 424/220 |
| 2,436,009 | 2/1948 | Kremiller | 138/31 |
| 3,534,407 | 10/1970 | Barthlome | 2/2.1 |
| 3,581,774 | 6/1971 | Oeland et al. | 138/31 |
| 3,669,151 | 6/1972 | Fleming | 138/31 |

*Primary Examiner*—Edgar W. Geoghegan
*Attorney, Agent, or Firm*—Christensen, O'Connor, Johnson & Kindness

[57] ABSTRACT

A hydraulic system pressure fluid accumulator apparatus is disclosed that meets peak load demands beyond the flow capacity of the system pump. Gas cylinder actuation of the accumulator piston augmented by system pressure feedback actuation of the piston metered by a pressure regulator valve maintains accumulator output pressure level substantially independent of piston displacement.

7 Claims, 1 Drawing Figure

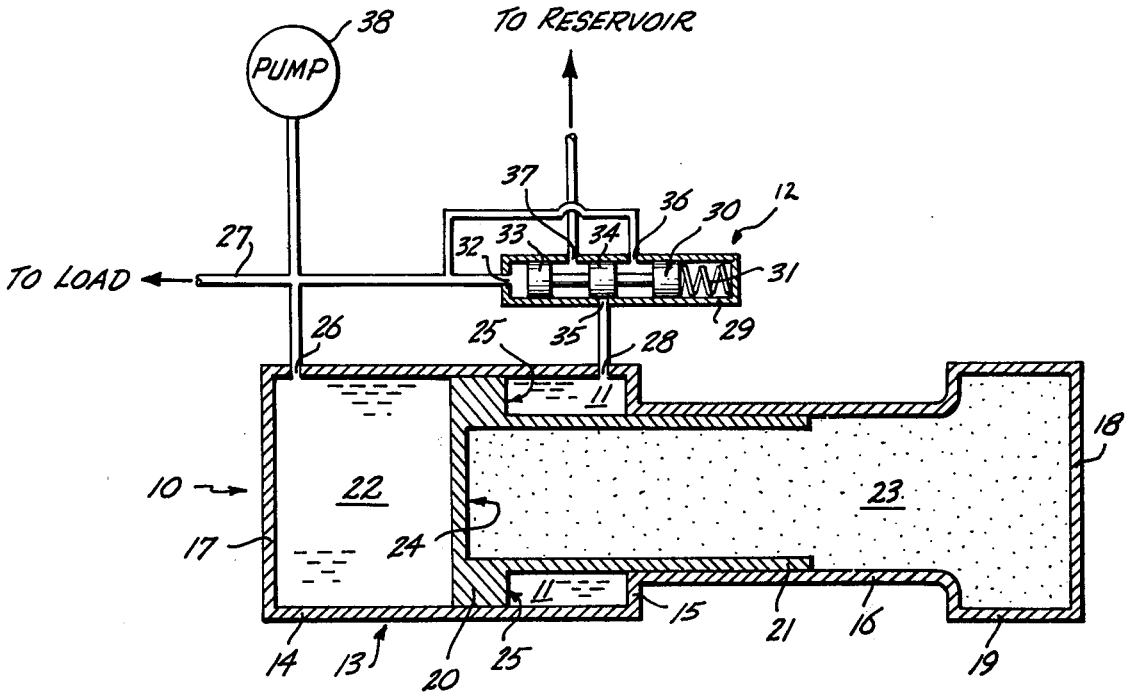
PUMP
38
TO RESERVOIR
37
36
30
12
27
TO LOAD
32
33
34
31
29
26
25
35
28
11
18
10
22
23
17
24
11
15
21
16
14
13
20
25
19

CONSTANT PRESSURE HYDRAULIC ACCUMULATOR

BACKGROUND OF THE INVENTION

This invention relates generally to hydraulic pressure accumulators and, more particularly, to constant pressure hydraulic accumulators for use in aircraft hydraulic control systems.

Hydraulic pressure accumulators are well-known components of various types of hydraulic systems. In simple hydropneumatic tank systems a column of air trapped in the top of a tank is compressed when water is pumped into the tank under pressure, as occurs under automatic control each time tank pressure drops below a pre-set value. No piston is required in the tank. In another type of conventional hydraulic accumulator, a piston and cylinder assemblage is connected to a hydraulic line. Hydraulic fluid occupies a volume open to the hydraulic line on one side of the piston and a gas occupies the volume on the other side of the piston. As the fluid pressure in the hydraulic system fluctuates, the gas is alternately compressed and expanded as the piston moves in response to the changing fluid pressure conditions. The compressed gas thus tends to oppose pressure changes and to provide a degree of pressure regulation.

When a gas-backed piston accumulator is used, during periods of slack hydraulic flow demand, the system pump delivers fluid under pressure into the accumulator and thereby compresses the gas entrapped behind the piston until the accumulator fluid pressure reaches system standard pressure, at which point the pump is stopped. When fluid is drawn by the load, the resulting flow (or drop in line pressure) restarts the pump. However, because of the pump's limited flow capacity, the accumulator supplies most of the temporary flow demand. Because of the compressibility of gas, a conventional accumulator employing a relatively large compressed gas reservoir is capable of augmenting pump flow with limited drop in pressure as it empties its contents. However, with an accumulator of practical size and weight, the pressure drop is more than desired and, because of that which does occur, the hydraulic motors and other devices operated by the system must be designed (usually at higher cost, size and weight) to operate over the full range of pressure drop experienced during maximum load flow.

Aircraft hydraulic systems represent an important application of the invention, for instance in the operation of a hydraulic servoactuator for actuating a control surface, such as an aileron. Most of the time the aileron is not used and its actuator draws little or no flow from the hydraulic fluid source. When the aileron is actuated, typically for a brief period of time, the power requirement of its hydraulic actuator can be very high. Conventional accumulators used in such applications suffer from certain disadvantages and limitations. Most importantly, the delivery pressure of such a conventional accumulator in responding to peak fluid flow demands falls more quickly below the standard operating line pressure of the system than is desirable. For example, if the standard operating pressure of the system is 3,000 pounds per square inch (PSI), a typical operating pressure in aircraft hydraulic systems, the accumulator will normally be fully charged to an air pressure which acts upon the piston of the accumulator to exert a pressure of 3,000 PSI upon the hydraulic fluid. The actual gas pressure, of course, may be higher or lower than 3,000 PSI in the fully charged state, depending upon the ratio of gas to hydraulic pressure areas acting on the accumulator fluid drive piston. Upon the occurrence of a sudden peak flow demand and a corresponding draw of hydraulic fluid from the pump and accumulator, the compressed gas acting on the piston will force hydraulic fluid into the system at a pressure which initially corresponds to the system operating pressure of 3,000 PSI, but which continuously decreases as the gas expands. Since the actuators and other components of the aircraft hydraulic system are designed for operation at or near the standard operating pressure, their performance progressively deteriorates as the line pressure drops and their design must be compromised in efficiency, size, weight and economics for the sake of developing adequate operating power throughout the power stroke.

The primary object and purpose of the present invention is to provide an improved accumulator which can be of limited size and weight yet capable of delivering hydraulic fluid at a pressure that drops during its discharge to a considerably lesser extent than with conventional accumulators of equal volumetric compressed gas capacity.

It is yet another object of this invention to provide an efficient and reliable, trouble-free accumulator system which permits utilization of less expensive, smaller and more lightweight hydraulic components for aircraft hydraulic control systems and similar applications.

SUMMARY OF THE INVENTION

In accordance with the present invention the improved accumulator apparatus includes a hydraulic fluid accumulator cylinder having a fluid drive piston therein and connected to deliver fluid into the associated hydraulic system. The fluid cylinder opens into a coaxially aligned gas cylinder of smaller diameter behind the piston. The fluid drive piston has mounted coaxially thereon a tubular skirt projecting from its back side and fitted and slidably sealed within the gas cylinder.

To the extent the skirt projects from the gas cylinder into the hydraulic fluid cylinder variably with piston movement, an annular chamber surrounding the skirt is formed behind the piston within the fluid cylinder. This annular chamber is connected in a feedback path from the hydraulic load line through a pressure regulator valve that admits fluid at system pressure into the annular chamber in response to a drop of system pressure below the standard value.

In the preferred design, the annular area of the piston which is exposed to auxiliary feedback fluid pressure in the annular chamber is made one-half the overall area of the piston, so that for any given displacement of the piston exactly half of the fluid expelled from the fluid reservoir is returned to the annular chamber. While only half of the fluid expelled from the fluid reservoir is available to operate hydraulic components in the system, the novel apparatus nevertheless provides a more constant delivery pressure in a demand flow system than prior or conventional accumulator devices can provide even though the latter be of larger size and weight.

BRIEF DESCRIPTION OF THE DRAWING

The FIGURE illustrates the preferred embodiment of the invention in schematic form with the piston/cylinder accumulator shown in simplified longitudinal section.

DESCRIPTION OF THE PREFERRED EMBODIMENT

Referring to the drawing, the preferred embodiment of the present invention includes a gas piston accumulator 10 with auxiliary drive chamber 11 coupled to a line feedback pressure regulator valve 12. The accumulator 10 and valve 12 are in fluid communication with the hydraulic system which may include various pumps, servoactuators and other components.

The accumulator 10 includes an accumulator casing 13 having a large diameter fluid cylinder 14 that steps down in diameter through a transverse annular connecting wall 15 into a coaxially aligned gas cylinder 16 of smaller diameter preferably having an interior cross-sectional area half that of fluid cylinder 14 for reasons explained below. End walls 17 and 18 close the outer ends of the fluid cylinder 14 and gas cylinder 16, respectively. An enlarged end chamber 19 is employed to shorten the length of the accumulator 10 without diminishing its volume.

A piston 20 is received in slidably sealed relationship within the hydraulic fluid chamber 14. A cylindrical skirt 21 is secured to and extends coaxially from the backside of piston 20 into the gas cylinder 16. The piston 20 is free to travel over a displacement range extending approximately from the annular connecting wall 15 to end wall 17, clearance for the cylindrical skirt 21 permitting it a like displacement range within the gas cylinder 16.

The accumulator casing 13, the piston 20 and the skirt 21 define three chambers within the accumulator casing 13. A variable volume hydraulic fluid reservoir 22 is enclosed by the fluid cylinder 14, between the movable forward face of piston 20 and end wall 17. A variable volume gas reservoir 23 is enclosed by the gas cylinder 16, within and beyond the skirt 21, between the end wall 18 and a central backside area 24 of the piston 20. The gas reservoir 23 contains a fixed quantity of gas trapped therein. Finally, the variable volume annular auxiliary drive chamber 11 is enclosed between the interior surface of the fluid cylinder 14 and the exterior surface of skirt 21, and between the connecting wall 15 and an annular backside piston area 25 of the piston 20.

A fluid port 26 located in accumulator casing 13 near end wall 17 maintains the fluid reservoir 22 in fluid communication with the system hydraulic line 27. A second fluid port 28 in casing 13 connects the annular auxiliary drive chamber 11 to the pressure regulator valve 12.

The position and motion of the piston 20 at any particular time is determined by the relative pressure of the hydraulic fluid in the fluid reservoir 22 and the auxiliary chamber 11 and the pressure of the gas in the gas reservoir 23. Since the quantity of gas trapped in the gas reservoir 23 is fixed, the gas pressure varies in proportion to the displacement of the piston 20. The position of the piston 20 may range from a fully charged limit position, wherein the annular backside area 25 of the piston 20 abuts against the annular connecting wall 15, to a fully discharged opposite limit position, wherein the piston 20 abuts against the end wall 17 of the fluid cylinder 14.

It will further be seen that the net force acting on the piston 20 at any time is a function of the difference between fluid pressure in fluid reservoir 22 and the sum of the fluid pressure in auxiliary drive chamber 11 and of the gas pressure in reservoir 23. With the cross-sectional area of the fluid cylinder 14 twice the cross-sectional area of the gas cylinder 16, a force exerted on the piston 20 by gas in the gas reservoir 23 at a given gas pressure will be exactly balanced by a force due to fluid in the fluid reservoir 22 at a fluid pressure of one-half the gas pressure. Likewise, a force exerted on the annular backside area 25 of the piston 20 by fluid at a given pressure in the auxiliary drive chamber 11 will be exactly balanced by a force on piston 20 due to fluid in fluid reservoir 22 at one-half the given fluid pressure.

The pressure regulator valve 12 includes a valve casing 29 which contains a valve spool 30 and a valve compression spring 31. A pressure port 32 opens into the valve casing 29 opposite the compression spring 31 to apply system fluid pressure against the adjacent end piston 33 of valve spool 30 in opposition to the return force of spring 31. With those forces in balance the middle piston 34 of valve spool 30 covers valve port 35 leading to auxiliary drive chamber 11. An inlet port 36 provides for flow of hydraulic fluid from the system hydraulic line 27 into the valve casing 29 at one end of middle piston 34 with the latter in its balanced position. An outlet port 37 leads from the valve casing 29 at the opposite end of middle piston 34 and permits return flow of fluid at a low pressure to a system hydraulic fluid reservoir (not shown). When system pressure in line 27 rises sufficiently to compress spring 31 and displace the spool 30, the auxiliary drive chamber 11 is relieved of pressure through ports 28, 35 and 37. When system pressure drops below regulated pressure, spring 31 displaces the valve spool 30 in the opposite direction to admit fluid from line 27 under pressure to chamber 11 through ports 36, 35 and 28. This augments the force of gas pressure acting on piston 20 to again raise pressure in the system line 27.

In the illustrated and preferred embodiment, the containment volume of gas reservoir 23 varies over a two-fold range as the piston 20 slides from its fully charged limit position to its fully discharged limit position. Thus, for a fixed quantity of gas at a constant temperature, the gas pressure similarly varies over substantially a two-fold range during a full stroke of the piston 20. In practice, the gas in gas reservoir 23 is initially compressed by means of an external pump and a gas inlet (not shown) to a pressure of 3,000 PSI, the standard operating pressure of the hydraulic system, with the piston 20 in its fully discharged limit position. When the hydraulic system pump 38 is subsequently turned on and pumps fluid from a reservoir (not shown) into the fluid reservoir 22, the piston 20 is forced to its fully charged limit position and the gas pressure in gas reservoir 23 is thereby raised to approximately 6,000 PSI.

During operating periods of low load demand, pump 38 supplies the entire demand with the system maintained by the pump 38 at its standard operating pressure of 3,000 PSI. Thus fluid in the fluid reservoir 22 is also maintained by the pump 38 at a pressure of 3,000 PSI with the piston held stationary in its fully charged position. At this pressure, the valve spring 31 of the pressure regulator valve 12 is compressed by line pressure sufficiently to keep the ports 35 and 28 open to the outlet port 37. As a result, with fluid pressure in fluid reservoir 22 at 3,000 PSI and gas in the gas reservoir 23 compressed to 6,000 PSI, piston 20 being in its fully charged position, pressure from line 27 cannot enter the auxiliary drive chamber 11 and thereby increase pressure above the standard 3,000 PSI value.

In the event of a peak or heavy load demand not met by the capacity of pump 38, system pressure drops permitting valve spring 31 to open ports 28 and 35 to inlet port 36 such that flow of fluid at system pressure into the annular auxiliary drive chamber 11 from the system hydraulic line 27 increases the net discharge drive force applied to the piston 20, and thereby boosts system pressure back toward standard pressure. Valve 12 shunts between its alternate positions, opening port 35 first to port 36 and then to port 37, in keeping system pressure within a range between standard pressure and a value acceptably less than such pressure.

Although various combinations of cylinder sizes, gas volumes and gas pressures may be employed to obtain a variation of the present invention offering significant performance advantages over a conventional accumulator, it can be demonstrated that the particular configuration of the preferred embodiment represents an optimum configuration in terms of the total size of the accumulator required to assure delivery of a given volume of hydraulic fluid at a minimum output pressure equal to the standard operating pressure of the system. Other configurations require an accumulator casing having a larger total volume in order to meet the same minimum performance requirements. Consequently, the optimum configuration is more particularly suited to applications where size is a critical factor, for example in aircraft and aerospace actuator systems.

Although with the illustrative design only half of the total volume of the stored fluid in fluid reservoir 22 is available to the hydraulic working system served by pump 38 and accumulator 10, as compared to a conventional accumulator of the same size, this fluid volume is available continuously substantially at the system operating pressure and thereby offers distinct advantages in hydraulic systems wherein a constant fluid supply pressure is desirable.

Although a preferred embodiment of the present invention is described and illustrated herein, various alterations, additions and modifications which may be apparent to one skilled in the art may be made without departing from the scope of the present invention, which is defined by the following claims.

The embodiments of the invention in which an exclusive property or privilege is claimed are defined as follows:

1. In a variable load demand hydraulic system having a pressure side and a return side and a pump operable to deliver only a portion of the intermittent peak load demanded of said system, a constant pressure hydraulic fluid accumulator assembly for augmenting the fluid flow output of said pump during intermittent periods of peak load demand comprising:

a hydraulic fluid accumulator having an accumulator fluid reservoir and including elements relatively movable to vary the volume of said reservoir, means maintaining said fluid reservoir in fluid communication with the pressure side of said hydraulic system;

gas compressor means having a gas reservoir containing a predetermined charge of gas, said gas compressor means including elements relatively movable to vary the volume of said gas reservoir, means operably connecting a movable element of said gas compressor means to a movable element of said fluid accumulator whereby the pressure of said gas in said gas reservoir causes pressure to be applied to fluid in said accumulator fluid reservoir;

auxiliary fluid drive means having an auxiliary fluid drive reservoir and including elements relatively movable to vary the volume of said auxiliary fluid drive reservoir, means operably connecting a movable element of said auxiliary fluid drive means to a movable element of said hydraulic accumulator whereby pressure exerted by fluid in said auxiliary drive reservoir causes pressure to be applied to fluid in said accumulator fluid reservoir; and, pressure regulator valve means responsive to system pressure and operable to connect said auxiliary fluid drive reservoir in fluid communication with the pressure side of said hydraulic system in response to system pressure less than a predetermined system fluid pressure and to connect said auxiliary fluid drive reservoir in fluid communication with the return side of said hydraulic system in response to system pressure above said predetermined system fluid pressure.

2. The accumulator assembly of claim 1 comprising a casing forming a fluid cylinder and also forming a gas cylinder of smaller diameter than and continuous with said fluid cylinder, said gas cylinder being connected in coaxial alignment with said fluid cylinder by an annular transition wall, a fluid drive piston slidably engaged in said fluid cylinder and having a cylindrical skirt projecting axially therefrom slidably into said gas cylinder, said piston and said skirt and said gas cylinder forming said gas reservoir adjacent one side of said piston, said piston and said fluid cylinder forming said fluid reservoir adjacent the opposite side of said piston, said piston, said skirt, said annular wall and said fluid cylinder behind said piston forming said auxiliary fluid drive reservoir adjacent said one side of said piston.

3. The accumulator assembly of claim 2 wherein said fluid drive piston is slidably movable between a fully charged position and a fully discharged position, said predetermined charge of gas having a first predetermined gas pressure when said piston is in said fully charged position, the ratio of said first predetermined gas pressure to said predetermined system fluid pressure being substantially equal to the ratio of the cross-sectional area of said fluid cylinder to the cross-sectional area of said gas cylinder.

4. The accumulator assembly of claim 3 wherein said predetermined charge of gas in said gas reservoir has a second predetermined gas pressure when said piston is in said fully discharged position, the ratio of said second predetermined gas pressure to said first predetermined gas pressure being substantially equal to the ratio of the cross-sectional area of said gas cylinder to the cross-sectional area of said fluid cylinder.

5. The accumulator assembly of claim 4 wherein the cross-sectional area of said fluid cylinder is substantially twice the cross-sectional area of said gas cylinder.

6. The device of claims 2, 3, 4 or 5 wherein said predetermined system fluid pressure is substantially 3,000 pounds per square inch.

7. The accumulator assembly of claims 2, 3, 4 or 5 wherein said pressure regulator valve means comprises a valve cylinder having first and second ends, a valve spool and a valve spring, said spool being slidably engaged within said valve cylinder, said valve spring being interposed within said valve cylinder between said valve spool and said first end of said valve cylinder, said valve cylinder having a pressure port operably maintaining said second end of said valve cylinder in fluid communication with said hydraulic system whereby said valve spring is compressed by said valve spool in response to fluid pressure of said hydraulic system, said valve cylinder having a reservoir port in fluid communication with said auxiliary drive reservoir and a system port in fluid communication with said pressure side of said hydraulic system and a discharge port in fluid communication with said return side of said system, said valve spool operating to open said reservoir port to fluid communication with said discharge port in response to fluid pressure in the pressure side of said hydraulic system substantially greater than said predetermined system fluid pressure, said valve spool operating to open said reservoir port to fluid communication with said system port in response to fluid pressure in the pressure side of said system substantially less than said predetermined system fluid pressure.

* * * * *